US005333823A

United States Patent [19]

Joseph

[11] Patent Number: 5,333,823

[45] Date of Patent: Aug. 2, 1994

[54] DETACHABLE DEVICE-HOLDING APPARATUS FOR A STEPLADDER

[76] Inventor: Thomas J. Joseph, 290 Wilbraham Rd., Hampden, Mass. 01036-9705

[21] Appl. No.: 77,851

[22] Filed: Jun. 16, 1993

[51] Int. Cl.[5] ..... A47G 23/02

[52] U.S. Cl. ..... 248/146; 182/129; 248/210; 248/311.2

[58] Field of Search ..... 248/210, 211, 238, 311.2, 248/146; 182/121, 122, 129, 120

[56] References Cited

U.S. PATENT DOCUMENTS

| | | | |
|---|---|---|---|
| 1,764,763 | 6/1930 | Stang . | |
| 1,858,656 | 5/1932 | Batherman . | |
| 2,308,180 | 1/1943 | Larsen et al. . | |
| 2,444,096 | 6/1948 | Faust . | |
| 2,444,584 | 7/1948 | Touchett . | |
| 2,461,825 | 2/1949 | Kowalski . | |
| 2,535,260 | 12/1950 | Braswell . | |
| 2,606,689 | 8/1952 | Kistner . | |
| 2,882,003 | 4/1959 | Stiffler | 248/238 X |
| 2,982,982 | 5/1961 | Swift | 248/210 X |
| 3,642,239 | 2/1972 | Zeiler | 248/146 X |
| 3,842,936 | 10/1974 | De Luca | 182/129 |
| 3,987,993 | 10/1976 | Hopkins . | |
| 4,266,686 | 5/1981 | Carter . | |
| 4,310,134 | 1/1982 | Schopp et al. . | |
| 4,356,854 | 11/1982 | McGee | 182/129 X |
| 4,653,713 | 3/1987 | Hamilton . | |
| 4,706,918 | 11/1987 | Wilson | 248/210 |
| 4,730,802 | 3/1988 | Chatham | 182/129 X |
| 4,824,060 | 4/1989 | Korda . | |
| 4,874,147 | 10/1989 | Ory | 182/129 X |
| 4,899,970 | 2/1990 | Berzina . | |
| 4,964,600 | 10/1990 | Lee | 248/146 |
| 5,052,581 | 10/1991 | Christ | 248/211 X |

FOREIGN PATENT DOCUMENTS

| | | | |
|---|---|---|---|
| 642101 | 6/1962 | Canada | 182/129 |
| 802835 | 2/1951 | Fed. Rep. of Germany | 182/129 |

*Primary Examiner*—J. Franklin Foss
*Attorney, Agent, or Firm*—Richard H. Kosakowski

[57] ABSTRACT

Apparatus is disclosed that removably attaches to the top platform of a stepladder, the apparatus includes a plate mounted to the stepladder, a bucket receptacle disposed on top of the plate, the bucket receptacle being used to hold items such as paint cans, nails or cleaning implements therein. The bucket receptacle is provided with tapered sides and a gasket to securely hold a paint can therewithin. The apparatus also includes one or more side attachments disposed on top of the plate integrally connected with the bucket receptacle. The side attachments are formed with various recesses or tool support shelves for securely holding various implements such as power tools, hand tools, paintbrushes or cleaning implements.

17 Claims, 2 Drawing Sheets

Fig. 4.
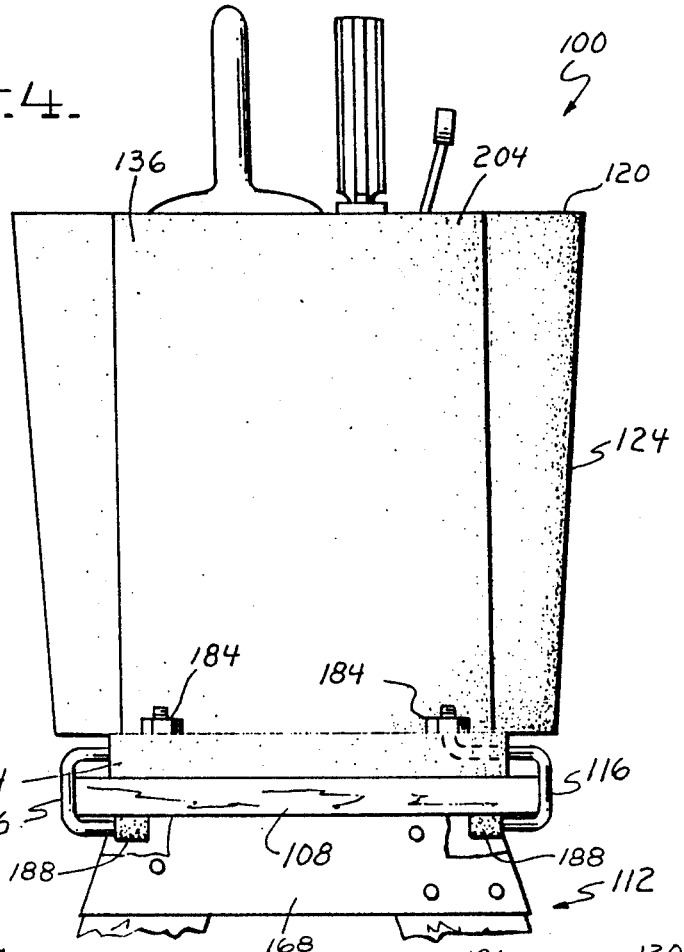
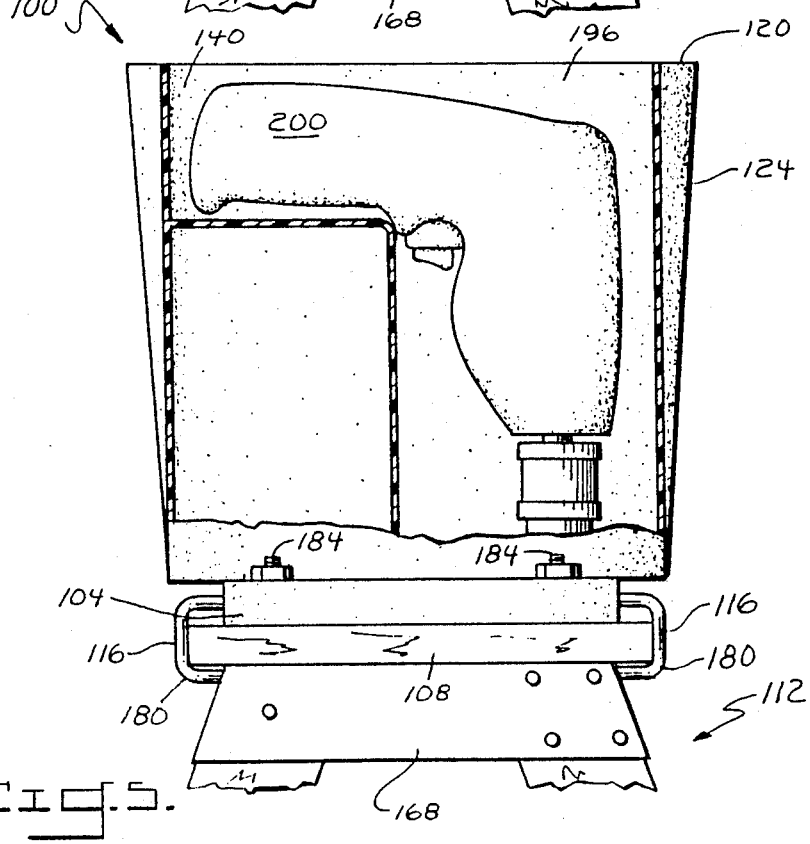
Fig. 5.

DETACHABLE DEVICE-HOLDING APPARATUS FOR A STEPLADDER

BACKGROUND OF THE INVENTION

This invention relates generally to a device-holding apparatus for a stepladder, and more particularly, to such an apparatus that removably attaches to the top of a stepladder and securely holds a paint can and various tools.

A stepladder is an old, well-known versatile device that enables a person to attain greater vertical heights above ground when performing various types of jobs. For example, the stepladder is used by different types of tradesmen, such as painters, carpenters and electricians. It is also widely used by the homeowner. The stepladder is a free-standing, self-supporting device that typically comprises a first frame having a pair of vertically-oriented step rails with a plurality of horizontally-oriented steps disposed therebetween and upon which a person climbs up and down the ladder. The stepladder also comprises a second frame including a pair of reinforced, vertically-oriented bracing rails connected together in various manners by one or more cross members. Typically, the second frame is pivotally mounted to brackets at the top of the ladder to place the ladder in either a working (unfolded) or a stored (folded) position. The distance or spread between the two frames in the working position is limited by an extensible connection (e.g., a hinged or pivoted pair of metal arms).

The stepladder also typically comprises a top shelf or platform that is enlarged relative to the other steps of the ladder. The stepladder may also include an integral folding shelf extension that projects a short distance outward beyond the second frame when the ladder is in the working position. When folded outward, the integral shelf extension provides a horizontal platform that is located vertically below the top platform of the ladder.

As mentioned before, a stepladder is typically used by persons in the act of painting or construction. Thus, a person standing on the ladder has a number of items in hand, such as paint cans, paintbrushes and/or various tools. The person may either place some or all of these items on the integral shelf extension or on the top platform of the ladder while performing the desired task. However, the integral shelf extension is somewhat flimsy in construction and it is only friction that prevents a paint can and/or tools from falling off. Similarly, the top platform of the ladder cannot securely hold a paint can and/or tools in place and keep them from falling off the ladder, especially when the ladder is moved. Thus, in order to avoid spillage of paint or droppage of tools, the items must be carried down by the worker each time it is desired to move the ladder into a new position. Carrying these items up and down the ladder leads to quicker fatigue and is time inefficient. A further problem is that the integral shelf extension is usually only big enough to fit a standard one-gallon paint can. The shelf extension is typically not big enough nor strong enough to properly support a larger paint can or trim bucket, such as a five gallon size can. Still further, there is no convenient place on the ladder to set down a wet paintbrush. In such instance, the worker usually lays the paintbrush on the side rim of the paint can. However, this often leads to paint being dripped down onto the floor from the brush.

It is known in the art for the worker on a ladder to wear a tool belt around the worker's waist. The belt typically holds a number of hand and/or power tools, such as screwdrivers, hammers, wrenches and drills. However, a problem with such configuration is that the balance of the worker on the ladder may be disrupted by the extra weight around the worker's waist. That is, the worker may lose his/her balance and fall from the ladder. Also, the tool belt usually cannot support a paint can in any manner.

Sometimes, paint can attachments are provided for holding brushes on the can. See, for example, U.S. Pat. Nos. 2606689, 2535260 and 4266686. However, in any of these approaches, the paint can still must be held by the worker on the ladder or rested upon the integral shelf support or the top platform of the ladder. Thus, the danger still exists of the paint can falling from the ladder or the paint spilling, or the necessity exists of having the worker hold the paint can while painting.

It is known in the art to provide a paint receptacle for use with roller-type paintbrushes. See, for example, U.S. Pat. Nos. 2444096 and 2444584. With such receptacles, the paint must be continually poured from the can into the receptacle. Also, the receptacle, which clips to the underside of either the top platform of the ladder or the integral folding shelf extension, is prone to paint spillage when the ladder is moved.

It is also known in the art to provide a paint can bucket holder that clips to the top platform of the ladder. See, for example, U.S. Pat. No. 2461825 to Kowalski. The bucker holder described therein is skeletal in form. That is, the holder comprises a frame having a pair of circular hoops joined together by four vertical cross pieces. Thus, the sides are not continual. This leads to a problem when a paint can smaller than a standard one-gallon size is used in that the smaller can may not be securely held within the holder. Also, the holder described therein makes no provision for holding tools of any kind.

It is further known in the art to provide a support for a paint can and a brush that releasably clamps to the side rail of a ladder. See, for example, U.S. Pat. No. 3987993 to Hopkins. However, a problem with this approach is that clamping the can to the sides of the ladder may affect the balance of the ladder. Also, the worker may lose his/her balance when reaching to the side of the ladder in order to place the brush in the can. Further, this approach makes no provision for holding tools.

U.S. Pat. No. 4899970 to Berzina discloses a paint can hanger having an integral top shelf. The hanger attaches to either the steps or the support rails of a stepladder, or to the rungs of an extension ladder. The hanger described therein does not attach to the top platform of a stepladder. A problem with this approach is that the fixed spacing or distance between the pair of support arms in the hanger of Berzina limits the hanger to a specific size of paint can. Thus, if the painter wants to use another size paint can, the painter must purchase another hanger with different spacing between the support arms.

Further, it is known in the art to provide a utility box that attaches to the top platform of a stepladder. See, for example, U.S. Pat. Nos. 4310134 and 4653713. When using the box disclosed in the '134 patent, paint cans, brushes, and/or tools are placed within the box. However, there is no means described for securely holding such items within the box. Thus, when the ladder with the box attached thereto is moved, the items within the box may shift such that the balance is thrown off, causing the box to fall off the ladder. The '713 patent attempts to obviate the disadvantages of the box in the '134 patent by providing a multi-compartment tray to more securely hold the items therewithin. However, there is no discussion in the '713 patent of providing the tray with the ability of securely holding a paint can therewithin.

Finally, it is known to provide apparatus that attaches to the top platform of a stepladder for specifically holding a blowtorch. See, for example, U.S. Pat. No. 1858656 to Batherman. However, the apparatus described therein is specifically limited to a blowtorch. There is no discussion therein of adapting the resilient clip to a paint can or other tools.

Accordingly, it is a primary object of the present invention to provide apparatus that removably attaches to the top platform of a stepladder and which safely and securely supports paint cans of various sizes, as well as paintbrushes and assorted hand and power tools.

It is a general object of the present invention to provide apparatus that removably attaches to a stepladder and that allows a paint can, brushes and tools to be conveniently accessible to a worker at a proper working level on the ladder.

It is another object of the present invention to secure paint cans, brushes and tools on a stepladder as it is moved, thereby allowing the work to be performed more safely and efficiently and eliminating the need to always carry down the items before moving the ladder and then carrying them back up again once the ladder has been moved in place.

It is still a further object of the present invention to securely hold paint cans, brushes and tools on a ladder so as to eliminate the droppage or spillage of paint or the droppage of tools, thereby minimizing the risk of accidents and breakage of tools.

The above and other objects and advantages of this invention will become more readily apparent when the following is read in conjunction with the accompanying drawings.

SUMMARY OF THE INVENTION

To overcome the deficiencies of the prior art and to achieve the objects listed above, Applicant has invented an apparatus that removably attaches to the top platform of a stepladder and which includes a bucket having tapered sides for securely holding therein a paint can of varying size and including one or more side attachments for securely holding various implements, such as hand and/or power tools and paintbrushes.

In the preferred embodiment, the apparatus includes a plate that removably attaches to the top platform of a stepladder by one or more clips. Mounted to, or integrally formed with, the plate on the top surface is a bucket having a generally round or cylindrical shape. The side of the bucket tapers downward in dimension from the top of the bucket toward the bottom. Mounted on the inside of the bucket, at a predetermined vertical distance from the top of the bucket, is a rubber gasket. The gasket, which is circular in shape, has a predetermined width chosen to support a standard one-gallon paint can on an upper surface of the gasket. The apparatus also includes one or more side attachments securely mounted to, or integrally formed with, the plate on its top surface. The side attachments, which generally rise to the same vertical height as the bucket, are also secured to, or integrally formed with, the side of the bucket. One side attachment includes a shelf having one or more holes and recesses formed therein for supporting one or more hand tools and paintbrushes. A second type of side attachment includes a contoured recess that supports a power tool, such as a drill.

BRIEF DESCRIPTION OF THE DRAWINGS

FIG. 4 is a left side view, partially cut away, of the bucket apparatus of FIG. 1; and FIG. 5 is a right side view, partially cut away, of the bucket apparatus of FIG. 1.

DETAILED DESCRIPTION OF THE PREFERRED EMBODIMENTS

Figure 1:
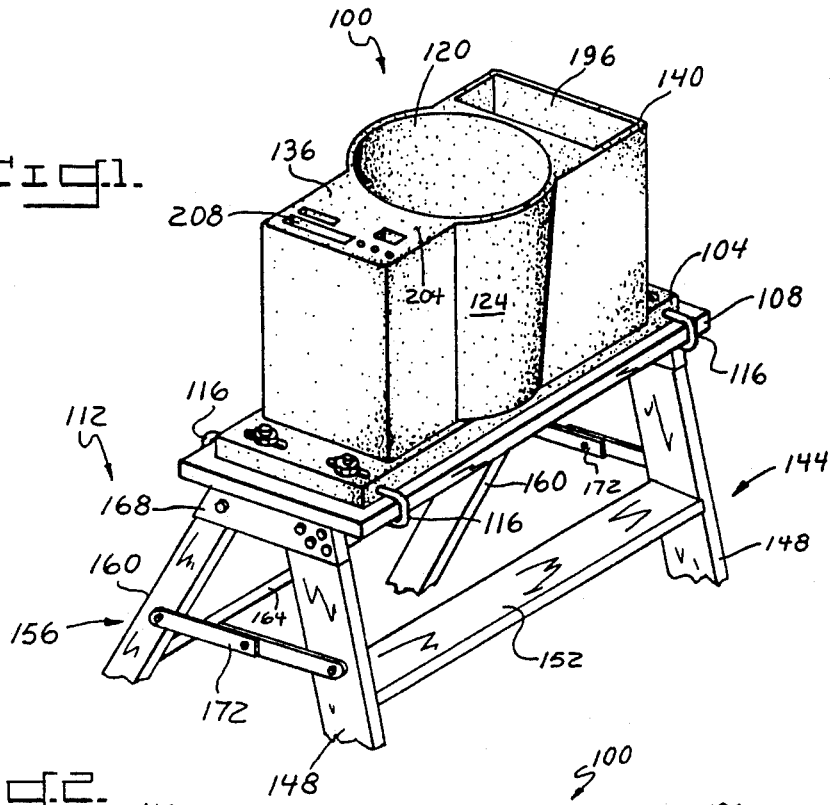
FIG. 1 is a perspective view of a typical stepladder with the bucket apparatus of the present invention mounted on a top platform of the ladder.

Referring to the drawings in detail, a preferred embodiment of bucket apparatus in accordance with the present invention is generally indicated and designated by the reference numeral 100. The bucket apparatus 100 includes a horizontal plate 104 that removably attaches to a top platform 108 of a conventional stepladder 112 by one or more clips 116. Disposed on the top surface of the plate 104 is a bucket 120 having a generally cylindrical shape. The surrounding side 124 of the bucket tapers downward in dimension from the top of the bucket 120 toward the bottom. Mounted on the inside of the bucket 120 is a circular rubber gasket 128 having a predetermined width chosen to support a standard one-gallon paint can 132 on an upper surface thereof. Also included are one or more side attachments 136, 140 that are disposed on top of the plate 104 and attached to the bucket 120 by being integrally formed therewith.

Referring to FIG. 1, there illustrated in perspective is the bucket apparatus 100 of the present invention mounted on a top platform 108 of a typical stepladder 112. Only a portion of the stepladder at the vertical top thereof is illustrated. The stepladder comprises a first frame 144 that includes a pair of vertically-oriented step rails 148 having a plurality of horizontally-oriented steps 152 mounted therebetween. The steps 152 enable a person to climb up or down the ladder 112. The ladder also includes a second frame 156 that comprises a pair of reinforced vertically-oriented bracing rails 160 having a plurality of horizontally-oriented bracing members 164 attached therebetween. The stepladder also includes a horizontally-oriented and generally planar top platform 108. The two frames 144, 156 attach to the underside of the top platform by means of brackets 168. The distance between the pairs of step rails 148 and bracing rails 160 is limited by a corresponding extensible connections 172 (e.g., hinged or pivoted metal arms). The second frame 156 is pivotally mounted to the brackets 168. The hinged extensible connection 172 cooperates with the pivotal connection of the second frame 156 to fold or unfold the ladder 112. In its unfolded (i.e., working) position, the ladder is a free-standing, self-supporting structure that allows a person to attain heights normally unreachable without the aid of such device.

The remaining figures, along with FIG. 1, illustrate in detail the bucket apparatus 100 of the present invention attached to the top platform 108 of the stepladder. The bucket apparatus includes a planar plate 104 that attaches to the top platform by means of four clips 116. When attached in this manner, the plate 104 is of the same horizontal orientation as that of the top platform 108. The plate may be comprised of any suitable material, such as plastic or metal. The material comprising the plate is irrelevant; however, it is preferred that the plate comprise a material that is similar to that which forms the remainder of the elements comprising the bucket apparatus 100 of the present invention, described hereinafter.

In a preferred embodiment of the present invention, the thickness of the plate 104 is in the range of one-half to one inch. However, it is to be understood that such thickness is purely exemplary; the thickness will depend, in part, on the type of material used to fabricate the plate, and also on the means for attaching the plate 104 to the top platform 108 of the stepladder. Further, when viewing the plate from the top plan view of FIG. 2, the length and width dimensions of the plate may be varied to appropriately fit the top platform of the stepladder. Typically, the length dimension (i.e., the left-to-right dimension) and the width dimension (i.e., the front-to-back dimension) of the top platform 108 of FIG. 2 will vary among stepladders. Thus, the plate is provided with elongated slotted holes 176 oriented along the width dimension and into which the corresponding clips 116 may be inserted. The positioning of the clips 116 may be varied within these slotted holes 176. However, if desired, the slotted holes 176 may instead be provided such that the plate 104 adjusts to the variable length dimension of the ladder.

Each clip 116 comprises a rod 180 having a threaded end that protrudes up through the slotted hole 176 above the top surface of the plate 104. A nut and washer 184 are screwed onto the threaded end to hold the rod 180 in place. The rod 180 extends vertically down through a portion of the thickness of the plate 104 and is bent at a 90-degree angle and inserted through a hole formed in the plate 104 transverse to the height of the plate. The hole may be elongated or slotted in the vertical dimension to allow the portion of the rod 180 inserted therein to move vertically. This allows the clip to properly fit the top platform 108. A U-shaped portion of the rod 180 extends out beyond the periphery of the plate 104. A bottom part of the U-shaped portion of the rod 180 is disposed underneath the top platform 108 of the stepladder. A rubber "foot" 188 is attached to the other end of the rod 180 and disposed underneath the top platform 108 of the stepladder 112.

In assembling the plate 104 to the top platform 108 of a stepladder 112, the worker initially loosens the corresponding nuts 184 on the four clips 116 and adjusts the clips so that the plate may be disposed flush on the top platform of the stepladder. The clips 116 are then moved inward toward the interior of the plate such that the U-shaped portion of each rod 180 engages the edge of the top platform 108 of the stepladder 112. The nuts 184 are then tightened down to securely hold the plate 104 to the top platform 108 of the stepladder 112.

Further, the clips 116 are illustrated for use with a top platform 108 having a uniform thickness. Such a platform 108 is generally found on modern wooden stepladders 112. However, stepladders fabricated from other materials, such as fiberglass, may have a platform 108 of different thickness and shape. The clips 116 may be designed in a different configuration to accommodate such thickness and/or shape. However, such design should be apparent to one of ordinary skill in the art, in light of the teachings herein.

The bucket apparatus 100 of the present invention includes a bucket 120 disposed on top of the plate 104 and located generally in the center thereof. As illustrated in the figures, the bucket 120 is generally round or cylindrical in shape, and has a side (i.e., a surrounding surface 124) that tapers downward in dimension from the top of the bucket to the bottom of the bucket. It is to be understood that the shape of the bucket 120 is not limited as such; instead, the bucket may have a number of straight sides 124. For example, the bucket 120 may be square or octagonal, if desired. Further, the bucket 120 need not have sides 124 that taper downward. Instead, the bucket may have sides 124 that taper upward or extend vertically such that the side 124 is perpendicular to the top surface of the plate 104 (i.e., no taper). However, since the bucket 120 is designed for use with standard round or cylindrical paint cans 132 or trim buckets, as described hereinafter, the bucket 120 of the preferred embodiment of the present invention is round with a tapered side 124.

Generally, the bucket 120 may be made of the same material as that of the plate 104. For example, if the plate 104 is fabricated from a metal such as aluminum, then the bucket 120 is also a metal and the bucket is welded or fastened in some other known manner to the plate at the bottom of the bucket. In the alternative, if the plate 104 is formed from a plastic, then the bucket 120 may also comprise plastic. In such case, the bucket 120 may be molded integral with the plate 104. In any event, the thickness of the side 124 of the bucket 120 is chosen so as to properly support various items therein. For example, it is contemplated that the bucket of the present invention may contain paint cans 132 or trim buckets of various sizes. Also, items such as nails, screws, or individual tools or cleaning products (not shown) may be disposed within the bucket 120.

In the preferred embodiment of the present invention, the diameter of the bucket 120 at its bottom surface thereof is chosen to be approximately seven inches. A standard one-gallon paint can 132 has a diameter of approximately six and one-half inches. To securely hold the one-gallon paint can 132 within the bucket 120 of the present invention, a rubber gasket 128 is inserted in the bucket. The gasket 128 has an outer surface with beveled or tapered sides whose angle of taper matches that of the taper of the bucket 120. The outer diameter of the gasket 128 is chosen such that when the gasket is inserted into the bucket 120, the top surface of the gasket is at a height that equals the lower portion of the bail sockets 192 on a standard one-gallon paint can 132. That is, the bottom surface of the one-gallon paint can 132 rests on the bottom surface of the bucket 120, while the bail sockets 192 on the one-gallon paint can rest on the upper surface of the gasket 128. The inner diameter of the gasket 128 that defines the circular opening of the gasket is slightly greater than six and one-half inches to accommodate a standard one-gallon paint can 132.

The gasket 128 may be comprised of rubber or other suitable materials, such as plastic or metal. In order to securely hold the gasket 128 within the interior of the bucket 120 against the inside of the side 124 of the bucket, the gasket may be provided with a number of clips (not shown) or other type of retaining devices. Further, a plurality of gaskets 128 having different size internal openings may be provided to accommodate different size paint cans 132. For example, to accommodate the popular one-quart paint can size, a gasket having both a smaller outside diameter and a smaller inside opening diameter may be provided such that the smaller one-quart paint can may rest on the bottom surface of the bucket 120. Further, if such smaller paint can 132 has bail sockets 192, then such sockets 192 may rest on the upper surface of the gasket 128. If the can is not provided with bail sockets 192, then it is sufficient that the inside diameter of the gasket 128 be sized such that the gasket prevents any lateral movement of the paint can 132 within the bucket 120.

Alternatively, for use with larger size paint cans 132, such as the popular one and a half or two-gallon trim paint cans, whose diameter meets or exceeds the seven-inch diameter of the bottom surface of the bucket 120, the bucket of the present invention with a tapered side 124 holds the trim paint can 132 in place by having the bottom edge at the bottom surface of the trim paint can rest on the side 124 of the bucket 120 at a point above the bottom surface of the bucket. In this instance, a gasket 128 may or may not be required. For example, a gasket 128 would not be required where the angle of the tapered side 124 of the bucket approximates the angle of tapered sides of the trim paint can 192. If used, a gasket may have an inner diameter that is sized to prevent any lateral movement of the trim paint can within the bucket. Still further, when it is desired to have the bucket 120 hold items such as nails, screws, tools or cleaning items, then the gasket 128 may not be used at all.

The bucket apparatus of the present invention also includes one or more side attachments 136, 140. Each attachment 136, 140 comprises generally a rectangular-shaped "box" that is disposed on top of the plate, or formed integral therewith, and is fabricated of the same material as that of the plate 104 and bucket 120. In the preferred embodiment of the present invention as illustrated in the figures, a pair of side attachments 136, 140 are included, the pair being disposed on opposite sides of the bucket 120. The side attachments 136, 140 are illustrated as being formed integral with the bucket 120. However, if desired, the side attachments 136, 140 may, instead, be formed separate from the bucket 120. In such case, the side attachments 136, 140 may be attached to the bucket by welding or by a clip. Alternatively, the side attachments 136, 140 may not attach at all to the bucket 120. Still further, the present invention may eliminate altogether the bucket 120. That is, one or more side attachments 136, 140 may be the only item disposed on, or formed integral with, the plate.

Figure 2:
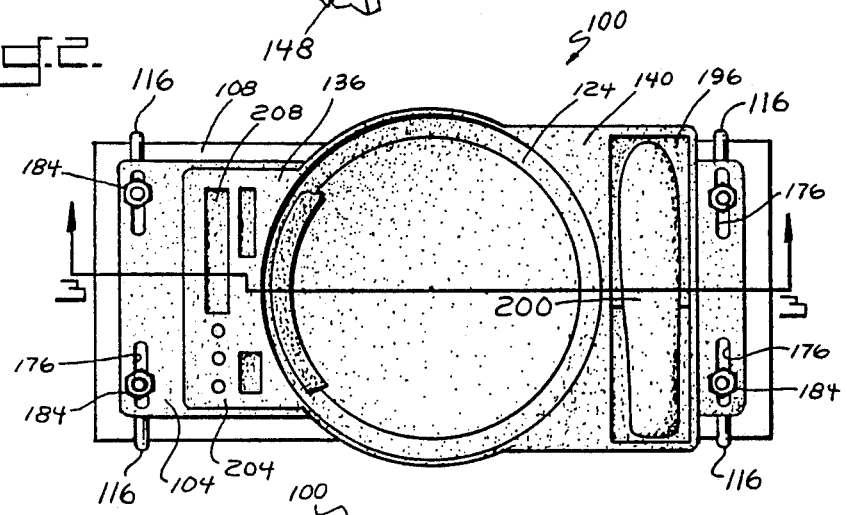
FIG. 2 is a top plan view of the bucket apparatus of FIG. 1.
Figure 3:
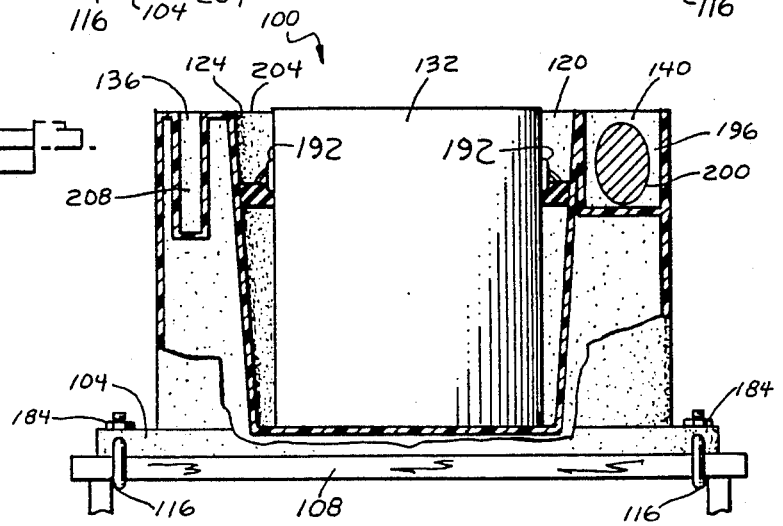
FIG. 3 is a front view, partially cut away, of the bucket apparatus of FIG. 1.

As best illustrated in FIGS. 2, 3 and 5, the right side attachment 140 has a cavity 196 formed therein that is contoured for holding an item such as a cordless electric drill 200. The right side of the cavity 196 is disposed at a vertical depth that is greater than that of the left side of the cavity. The drill 200 fits securely within the cavity 196 as illustrated in FIG. 5. In the alternative, it is envisioned that the cavity 196 may be used to have a liquid such as a paint thinner poured into a portion of the cavity on the right side. This allows a worker to dip a paintbrush into the cavity. In the alternative, other types of liquids, such as paints or cleaning agents, may be poured directly into the right side of the cavity 196 of the right side attachment 140.

In contrast, the left side attachment 136 has a horizontally-oriented shelf 204 formed therein. The shelf 204 has openings of various sizes formed therein to securely hold a number of different types of tools or cleaning implements, such as screwdrivers, wrenches or paintbrushes. If desired, one or more enclosures 208 may be formed below the surface of the shelf to contain a paintbrush. The enclosure 208, which may be removable, contains paint that drips from the paintbrush. In the alternative, the enclosure 208 may contain, if desired, paint thinner or paint.

The bucket apparatus 100 of the present invention has been described as having a pair of side attachments 136, 140 disposed on opposite sides of the bucket 120. It is to be understood, however, that the present invention is not limited to such arrangement; any number of side attachments 136, 140 may be provided, if desired, in accordance with the present invention in light of the teachings herein. A pair of side attachments 136, 140 disposed on opposite sides of the bucket 120 are chosen for the preferred embodiment to equally distribute the weight on the top platform 108 of the stepladder 112. Such equal weight distribution lessens the chance the ladder will tip over or items will fall when the ladder is moved.

Also, the side attachments 136, 140 may have their orientations with respect to the bucket reversed. That is, the right side attachment 140 has been illustrated as having a cavity 96 for holding a power drill 200, either cordless or having an electric power cord. Instead, the drill cavity 200 may be disposed on the left side of the bucket, so as to accommodate someone who is left-handed. Further, such accommodation may be carried out by use of interchangeable drop-in cavities. That is, each side attachment 136, 140 may comprise an outer frame into which a drop-in cavity frame is inserted. Then, various drop-in cavity frames may be utilized to accommodate different tools.

Further, it is to be understood that the physical structure of the side attachments 136, 140 described herein is purely exemplary. The side attachment may have other types of cavities or shelves formed therein for holding various implements. Still further, the bucket apparatus 100 of the present invention may include more than one bucket 120 so as to hold more than one paint can or more than one type of implement such as nails or screws. Also, if desired, a side attachment 136, 140 may comprise a continual cavity which encircles most or all of the circumference of the bucket 120.

The present invention has been described as being attached to the top platform 108 of the stepladder 112 by means of particular clips 116. However, the present invention is not limited as such; the present invention contemplates the use of other means for attaching the plate securely to the platform. For example, the plate 104 may be more permanently attached to the platform 108 by screws or nails. In these instances, the slotted holes 176 and corresponding clips 116 described herein may not be required. For example, the plate 104 may attach to the top platform 108 of the stepladder 112 by means described in the aforementioned U.S. Pat. No. 2461825 to Kowalski, or the aforementioned U.S. Pat. No. 1858656 to Batherman, or the aforementioned U.S. Pat. No. 4310134 to Schopp et al., or U.S. Pat. No. 2308180 to Larsen et al.; all of these patents being hereby incorporated by reference.

The present invention has been described as having a circular bucket 120 with particular diameters. However, the invention is not limited as such. Instead, the diameters or sizes of the internal portion of the bucket may be chosen as desired to accommodate items such as paint cans, nails or cleaning implements and hold them securely within the bucket.

It should be understood by those skilled in the art that obvious structural modifications can be made without departing from the spirit of the invention. Accordingly, reference should be made primarily to the accompanying claims, rather than the foregoing specification, to determine the scope of the invention.

Having thus described the invention, what is claimed is:

1. Apparatus that attaches to a top platform of a stepladder, the apparatus being used to hold various items in a secure manner therewithin and to provide access to the items for a person standing on the stepladder, the apparatus comprising:

a. a horizontal planar plate, having a planar under surface disposed to rest on the top platform of the stepladder;

b. means for securing the plate to the top platform of the stepladder;

c. a cylindrical bucket receptacle disposed on a top surface of the plate and having a cylindrical side wall surrounding the receptacle, the side wall being of a height sufficient to enclose a majority of the height of a standard one-gallon size paint container; and d. one or more side receptacles disposed on the top surface of the plate adjacent to the bucket receptacle.

2. The apparatus of claim 1, wherein the cylindrical bucket receptacle side wall tapers inward from a top portion of the bucket receptacle down toward a bottom portion of the bucket receptacle.

3. The apparatus of claim 1, further comprising means for supporting a container within the bucket receptacle, the means for supporting being mounted to an inner surface of the bucket receptacle cylindrical side wall.

4. The apparatus of claim 3, wherein the means for supporting a container comprises a gasket mounted to the inner surface of the bucket receptacle cylindrical side wall.

5. The apparatus of claim 1, wherein one of the side receptacles has means, formed integral therewithin, for supporting one or more tools and the like therein.

6. The apparatus of claim 1, wherein the means for securing the plate to the top platform of the stepladder comprises one or more clips that attach to the top platform of the stepladder, each clip being wrapped around an edge of the top platform of the stepladder and in contact with the edge and a bottom surface of the top platform of the stepladder to hold the plate securely thereto.

7. The apparatus of claim 1, wherein one of the side receptacles has a shelf formed therein for supporting one or more tools or the like therein.

8. The apparatus of claim 1, wherein one of the side receptacles has a contoured cavity formed therein for supporting one or more tools or the like therein.

9. The apparatus of claim 1, wherein one of the side receptacles has a contoured cavity formed therein for containing a liquid therein.

10. The apparatus of claim 1, wherein at least one of the side receptacles is formed integral with the bucket receptacle.

11. The apparatus of claim 1, wherein at least one of the one or more side receptacles is disposed apart from the bucket receptacle.

12. Apparatus that attaches to a top platform of a stepladder, the apparatus being used to hold various items in a secure manner, and to provide access to the items for a person standing on the stepladder, the apparatus comprising:

a. a plate operable to be disposed on a top platform of a stepladder;

b. a plurality of adjustable clips operable for securing the plate to the top platform of the stepladder, each of the plurality of clips being wrapped around an edge of the top platform of the stepladder and in contact with the edge and a bottom surface of the top platform of the stepladder to hold the plate securely thereto; and c. at least one receptacle disposed on a top surface of the plate, each receptacle having formed therein means for supporting one or more tools and the like therein

13. The apparatus of claim 12, wherein the means for supporting one or more tools and the like therein comprises a contoured cavity.

14. The apparatus of claim 12, wherein the means for supporting one or more tools and the like therein comprises a contoured cavity shaped to hold a power drill.

15. The apparatus of claim 12, wherein the means for supporting one or more tools and the like therein comprises a shelf having one or more holes formed therein.

16. The apparatus of claim 12, wherein the means for supporting gone or more tools and the like therein comprises a shelf having one or more enclosed recesses formed therein.

17. Apparatus that attaches to a top platform of a stepladder, the apparatus being used to hold various items, including a paint can being of a size that is at least equal to a standard one-gallon size paint can, in a secure manner and to provide access to the items for a person standing on the stepladder, the apparatus comprising:

a. a horizontal planar plate, having a planar undersurface disposed on the top planar platform of the stepladder;

b. a plurality of clips for securing the plate to the top platform of the stepladder;

c. a cylindrical bucket receptacle disposed on a top surface of the plate, the bucket receptacle having a circular side that tapers inward from a top portion of the bucket receptacle down toward a bottom portion of the bucket receptacle, the circular side being of a height sufficient to enclose a majority of the height of the standard one-gallon size paint can, a diameter of a bottom surface of the cylindrical bucket receptacle being equal to or greater than a diameter of the standard one-gallon size paint can such that a bottom surface of the paint can can rest on top of the bottom surface of the cylindrical bucket receptacle; and d. a gasket mounted to an inner surface of the side of the bucket receptacle, the gasket being operable to prevent any lateral movement of the paint can within the bucket receptacle.

* * * * *